US006742452B2

(12) United States Patent
Mayer et al.

(10) Patent No.: US 6,742,452 B2
(45) Date of Patent: Jun. 1, 2004

(54) METHOD FOR PRESETTING AN INK FEED IN MULTI-COLOR PRINTING

(75) Inventors: Martin Mayer, Ladenburg (DE); Nikolaus Pfeiffer, Dover, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 43 days.

(21) Appl. No.: 10/034,915

(22) Filed: Nov. 21, 2001

(65) Prior Publication Data

US 2002/0124752 A1 Sep. 12, 2002

(30) Foreign Application Priority Data

Nov. 23, 2000 (DE) ..... 100 58 041

(51) Int. Cl.[7] ..... B41F 31/02; B41F 33/00
(52) U.S. Cl. ..... 101/365; 101/484
(58) Field of Search ..... 101/365, 364, 101/335, 483, 484, 350.1; 358/1.9

(56) References Cited

U.S. PATENT DOCUMENTS 4,200,932 A * 4/1980 Schramm et al. ..... 101/350.1
4,656,941 A * 4/1987 Brovman ..... 101/483
4,829,898 A * 5/1989 Wieland ..... 101/483
5,031,535 A 7/1991 Kipphan et al.
5,170,711 A * 12/1992 Maier et al. ..... 101/365
5,530,656 A * 6/1996 Six ..... 702/108
5,896,814 A * 4/1999 Junghans et al. ..... 101/365
5,947,029 A * 9/1999 Loeffler et al. ..... 101/484
5,967,049 A * 10/1999 Seymour et al. ..... 101/484
6,041,708 A * 3/2000 Kipphan et al. ..... 101/365
6,119,594 A * 9/2000 Kipphan et al. ..... 101/365

FOREIGN PATENT DOCUMENTS

GB 2 017 001 A * 1/1979 ..... B41F/31/02

* cited by examiner

*Primary Examiner*—Andrew H. Hirshfeld
*Assistant Examiner*—Hoai-An D. Nguyen
(74) *Attorney, Agent, or Firm*—Laurence A. Greenberg; Werner H. Stemer; Gregory L. Mayback

(57) ABSTRACT

A method for presetting an ink feed in multi-color printing derives presetting values for zonal ink metering devices and for ink metering rollers acting over a printing width from a set value for a weight per unit area of a full tone area, zonal area coverage values and an ink stripe width. For each of a plurality of printing inks, the zonal ink metering devices and the ink metering rollers are preset in dependence of an ink demand for an image to be printed.

4 Claims, 3 Drawing Sheets

METHOD FOR PRESETTING AN INK FEED IN MULTI-COLOR PRINTING

BACKGROUND OF THE INVENTION

Field of the Invention

The invention relates to a method for presetting an ink feed in multi-color printing.

In order to increase the efficiency of a printing operation, measures are taken to reduce the set-up time of printing presses to a minimum. To save time and money different systems of a printing press are preset during the initial set-up phase. For performing a presetting, information concerning the print job to be processed is used, like for example the format and thickness of the sheets, and process information, like for example the inking system temperature and atmospheric humidity of the ambient air. In printing presses having zonally acting ink metering devices, like for example ink duct blades, and having ink metering rollers that act over the print width, like for example ductor rollers, the presetting is performed based on data related to zonal area coverage values in the image that is to be printed. In printing presses which use printing plates, these data are gathered from the optoelectronic scanning of the printing plate for the separate colors to be printed, or one uses image data, which are present during the generation of a printing image on a computer. According to the known correlation between the ink film thickness on a printed product and the density in the printed image for a given (primary) color, the gap between the ink metering elements and an ink duct roller that is assigned to it, and the color stripe width on a ductor roller can be preset. In systems having an automatic presetting, the aforementioned correlations between ink film thicknesses or density values and gap widths and ink stripe widths for the process colors cyan, magenta, yellow and black are stored for example in the form of characteristic curves in a control unit. In particular when printing packaging material often times special inks are used in addition to the regular process inks. Because the analysis of a multitude of characteristic curves for special inks is very complex, in practical applications the characteristic curves of the process inks are used. This method of presetting results in unsatisfactory results because, as a rule, special inks are to be printed with film thicknesses that differ from those of the process colors.

Published, Non-Prosecuted German Patent Application No. DE 44 01 536 A1 discloses the use of characteristic curves for controlling or regulating an operating process of a printing press. Based on characteristic curves of a virtual reference printing press and further in dependence of at least one further parameter, a numeric approximation method derives setting values for actuating elements in an actual printing press. This method relates to a procedure for printing with regular process colors, because deriving setting values from characteristic curves of a virtual reference printing press is not feasible due to the multitude of possible special inks.

SUMMARY OF THE INVENTION

It is accordingly an object of the invention to provide a method for presetting an ink feed in multi-color printing which overcomes the above-mentioned disadvantages of the heretofore-known methods of this general type and which reduces the set-up time of a printing press.

With the foregoing and other objects in view there is provided, in accordance with the invention, a method for presetting an ink feed in multi-color printing, the method includes the steps of:

deriving presetting values for zonal ink metering devices and for ink metering rollers acting over a printing width from a set value for a weight per unit area of a full tone area, zonal area coverage values and an ink stripe width; and presetting, for each of a plurality of printing inks, the zonal ink metering devices and the ink metering rollers prior to printing, corresponding to an ink demand for an image to be printed.

According to the method of the invention, in order to derive the presetting values for the ink metering device and for the ink metering rollers the weight per unit area for a full tone area or solid ink region and the specific weight of the printing ink are used in addition to the area coverage values. That is why the method is particularly advantageous when printing with special inks or special colors, but it is not limited to special inks. Special inks are increasingly produced with computer controlled ink mixing systems and are used for printing packaging material. For determining the amount of printing ink that is needed for the application, the weight per unit area is determined as the amount of ink per printed full tone area or solid ink area. For standard ink mixtures, the weight per unit area is generally known within given limits of accuracy and can be used accordingly, so that in this case the printing of a test print for the determination of the weight per unit area can be avoided. The required ink film thickness can be calculated from the weight per unit area and the specific weight of the mixed-up printing ink. In printing presses with an ink gap that opens and closes between an ink metering element and an ink duct roller and with a ductor-type inking system, the ink zone opening to be preset is proportional to the calculated ink film thickness on a sheet or a web at a given lift or stroke of the ink duct roller.

For each of the inks or colors to be printed, in particular for each of the special inks or colors, a characteristic curve for the ink zone presetting can be created corresponding to the required ink film thickness.

The characteristic curves for the ink presetting can either be determined analytical, e.g. by using an ink unit simulation or can be determined empirical, by using print tests. One possibility of realizing the ink presetting for special inks is the use of correction factors on a characteristic curve of a base ink or process ink. The correction factors describe the film thickness ratios of a special ink to a base ink. Furthermore there is the possibility to use further parameters, like for example adhesive power and viscosity of the printing ink for the calculation of the presetting values. Aside from a reduced number of characteristic curves for the presetting, this approach has the advantage, that the characteristic curve can simply be adapted to modifications of the rheological characteristics of printing inks.

Another mode of the method according to the invention includes the step of deriving the presetting values by additionally taking into account a respective specific weight of given ones of the plurality of printing inks.

Yet another mode of the method according to the invention includes the step of determining the set value for the weight per unit area by using a test print wherein a spectral color measurement value of the test print corresponds to the set value for the weight per unit area.

A further mode of the method according to the invention includes the step of deriving presetting values for a special ink to be used for printing by using correction factors for presetting values provided for a base ink.

Other features which are considered as characteristic for the invention are set forth in the appended claims.

Although the invention is illustrated and described herein as embodied in a method for presetting an ink feed in multi-color printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
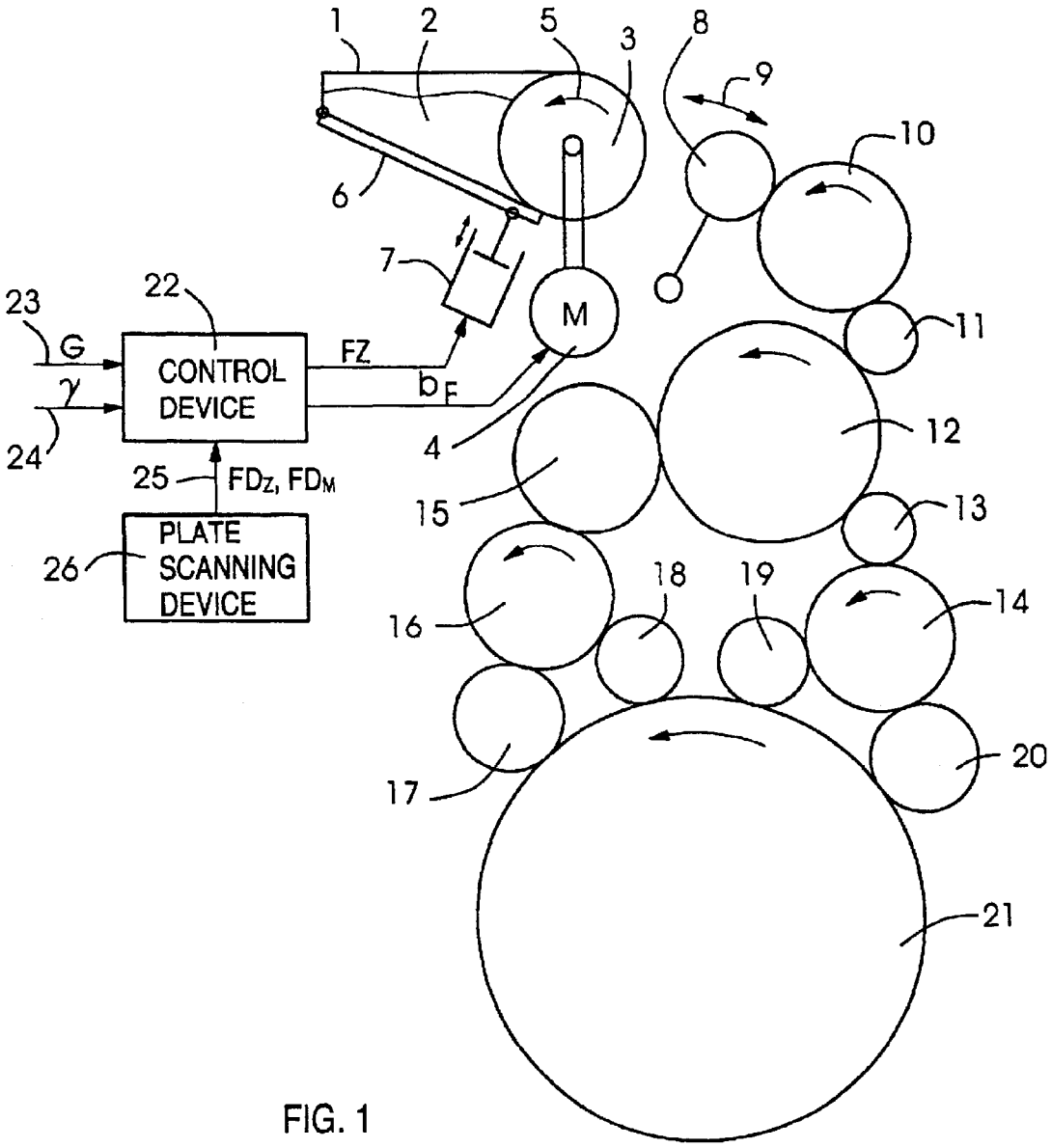
FIG. 1 is a schematic side elevational view of an inking system of a printing unit.

Referring now to the figures of the drawings in detail and first, particularly, to FIG. 1 thereof, there is shown a ductor-type inking system of an offset printing press including an ink duct or ink fountain 1 in which printing ink 2 is stored. An ink duct roller 3 dips into the printing ink 2, and a motor M indicated by reference numeral 4 drives the ink duct roller 3 in the direction of the arrow 5. In the bottom area of the ink duct 1, a row of ink duct blades 6 is provided, which are disposed in zones and which are spaced at small distances from one another over the width of the ink duct roller 3. Each ink duct blade 6 is linked to an adjustment cylinder or actuation cylinder 7, with which the distance of an ink duct blade 6 to the outer surface of the ink duct roller 3 can be adjusted. The bigger the distance, the more printing ink 2 is taken away by the ink duct roller 3. Furthermore, the inking system includes an ink vibrator or vibrating ink roller 8. The ink vibrator 8 executes a swiveling movement 9 between the ink duct roller 3 and a driven distributor roller 10.

A row of ink transfer rollers 11–16 and plate inking rollers 17–20 are provided downstream from the distributor roller 10. The plate inking rollers 17–20 are in rolling contact with the ink transfer rollers 14, 16 and a printing forme cylinder 21. The ink transfer rollers 12, 14, 16 that are shown with an arrow and the printing forme cylinder 21 are driven via a gear train, while all the other ink transfer rollers 11, 13, 15 and the ink transfer rollers 17–21 are driven by friction with the neighboring rollers. A control device 22 is connected to adjustment cylinders 7 and the motor 4. The control device 22 has input location 23, 24, 25 for data concerning the weight per unit area G, the specific weight y and for the area coverage $FD_z$. The zonal area coverage values $FD_z$ are supplied by a plate scanning device 26.

Figure 2:
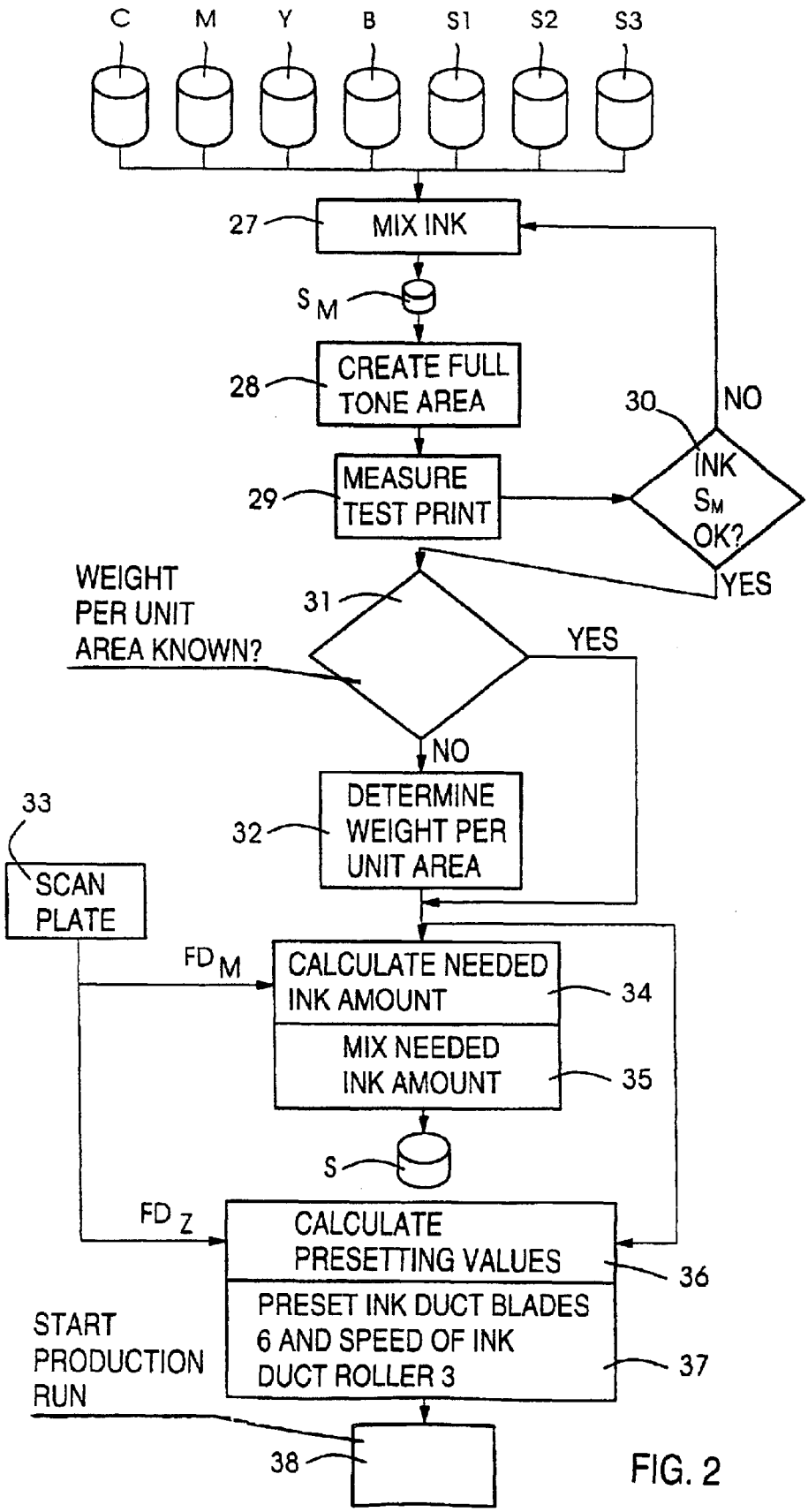
FIG. 2 is a flow chart illustrating method steps of the method according to the invention.

The method according to the invention is described with reference to the flow chart shown in FIG. 2. According to an exemplary embodiment, a printed image with the four process inks or base inks C, M, Y, B and a special ink S is to be created. Corresponding to an ink recipe, in step 27, the process inks C, M, Y, B and the special inks S1, S2, S3 are mixed with a computer-controlled ink mixing system. With the mixed ink $S_M$, in a step 28, a test print of a full tone area is created, which is measured spectrally in a step 29. In a step 30 it is examined, if the mixed ink $S_M$ shows a desired color value. If the mixed ink $S_M$ does not correspond to the set point S, then the steps 27–29 are repeated. If the mixed ink $S_M$ corresponds to the set point S, then in a step 31 it is checked, if the weight per unit area G of the mixed ink $S_M$ is already known. The weight per unit area G corresponds to the mass of the printing ink 2 per unit area on the test print. If the weight per unit area G is not known, then it is determined in a subsequent step 32. In a separately performed step 33, the medium area coverage $FD_M$ and the zonal area coverage $FD_Z$ for the printing plate are determined, with which the mixed ink S is to be printed. From the values for the medium area coverage $FD_M$ and the weight per unit area G, in steps 34, 35, the needed amount of ink is calculated and mixed. If the result from step 31 is, that the weight per unit area G is already known, then one can directly go to the calculations of steps 34, 35. The mixed ink S is supplied to the ink duct 1.

From the values for the area coverage $FD_Z$ in the individual ink zones and from the weight per unit area G, the presetting values for the ink duct blade 6 and the revolutions per minute of the ink duct roller 3 are calculated and adjusted in steps 36, 37, with a known specific weight of the printing ink 2. If the presettings for all separated inks C, M, B, Y, S is taken care of, then in the last step 38 the production run can be started.

Figure 3:
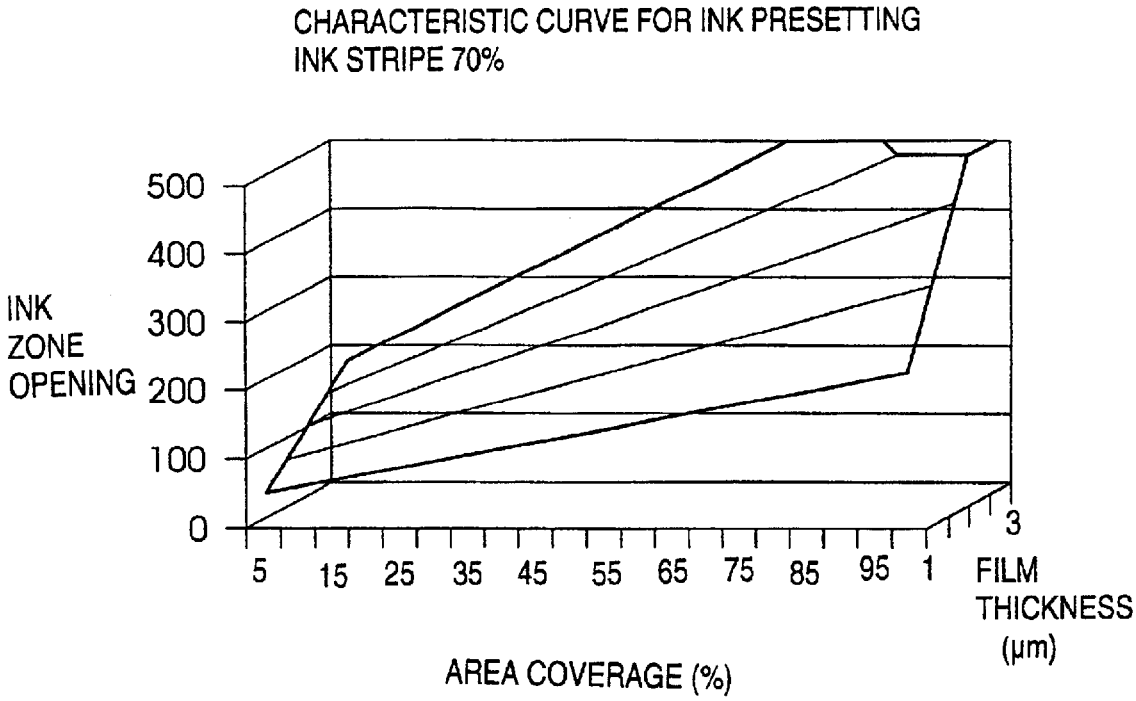
FIG. 3 is a graph of a three-dimensional characteristic curve.

The calculation step 36 can be executed by use of a three-dimensional field of characteristic curves, like it is shown in FIG. 3. By using the field of characteristic curves, when there is a given ink duct lift or stroke and respectively an ink stripe of e.g. 70%, the ink zone opening FZ of the ink duct blade 2 for the special ink S in question can be calculated in dependence from the zonal area coverage value $FD_Z$ and the ink film thickness of the printing ink 2 in the printed image. The ink zone opening for an ink duct blade 6 results from the following relation:

$$FZ=G\ (a_0+a_1 * (FD_Z/b_F)+a_2 * B)$$

Wherein G is the weight per unit area, $FD_Z$ is the zonal area coverage value, $b_F$ is the width of the strip that has been taken over by the ink duct roller 3 via the ink vibrator 8, B is a quantity that characterizes the print material or substrate, like for example constants for different paper grades, like art paper, matt paper or uncoated paper and $a_0$, $a_1$, $a_2$ are correction factors. The correction factors $a_0$, $a_1$, $a_2$ result for example from influencing variables such as length of the inking unit, Theological characteristics of the ink and configuration of the ink duct.

Through the use of the ink duct blades 6, which are preset via the adjustment cylinders 7, and the periodic activation of the feed of the ink duct roller 3 with the motor 4, the ink vibrator 8 takes over the printing ink 2 from the ink duct roller 3. The ink transfer from the ink duct roller 3 over the ink vibrator 8 and the remaining rollers 10–20 is done by ink splitting. The presetting ensures that the time until the produced prints have a desired quality is minimized.

Starting with the presetting values, the ink duct blades 6 and the rotational speed or the feed of the ink duct roller 3 are continuously adjusted anew within the limits of the control of the inking process.

We claim:

1. A method for presetting an ink feed in multi-color printing, the method which comprises:

deriving presetting values for zonal ink metering devices and for ink metering rollers acting over a printing width from a set value for a weight per unit area of a full tone area, zonal area coverage values and an ink stripe width; and presetting, for each of a plurality of printing inks, the zonal ink metering devices and the ink metering rollers prior to printing, corresponding to an ink demand for an image to be printed.

2. The method according to claim 1, which comprises deriving the presetting values by additionally taking into account a respective specific weight of given ones of the plurality of printing inks.

3. The method according to claim 1, which comprises determining the set value for the weight per unit area by using a test print wherein a spectral color measurement value of the test print corresponds to the set value for the weight per unit area.

4. The method according to claim 1, which comprises deriving presetting values for a special ink to be used for printing by using correction factors for presetting values provided for a base ink.

* * * * *